US010022724B2

(12) United States Patent
Weeks et al.

(10) Patent No.: US 10,022,724 B2
(45) Date of Patent: Jul. 17, 2018

(54) STEPPED SHREDDER HAMMERS

(71) Applicant: ESCO Corporation, Portland, OR (US)

(72) Inventors: Michael R. Weeks, Portland, OR (US); David M. Graf, Scappoose, OR (US); Christoper M. Carpenter, Tualatin, OR (US)

(73) Assignee: ESCO CORPORATION, Portland, OR (US)

( * ) Notice: Subject to any disclaimer, the term of this patent is extended or adjusted under 35 U.S.C. 154(b) by 784 days.

(21) Appl. No.: 14/541,141

(22) Filed: Nov. 14, 2014

(65) Prior Publication Data

US 2015/0129695 A1 May 14, 2015

Related U.S. Application Data

(60) Provisional application No. 61/904,130, filed on Nov. 14, 2013.

(51) Int. Cl.
*B02C 13/28* (2006.01)
*B02C 13/00* (2006.01)

(52) U.S. Cl.
CPC ..... *B02C 13/28* (2013.01); *B02C 13/00* (2013.01); *B02C 2013/2808* (2013.01)

(58) Field of Classification Search
CPC ..... B02C 13/28; B02C 13/2804; B02C 2013/2808
USPC ..... 241/194
See application file for complete search history.

(56) References Cited

U.S. PATENT DOCUMENTS 5,443,418 A * 8/1995 Frodin ..... B24D 3/06 451/540
D560,459 S * 1/2008 Cho ..... D8/70
D572,278 S * 7/2008 Cho ..... D15/126

* cited by examiner

*Primary Examiner* — Faye Francis
(74) *Attorney, Agent, or Firm* — John Anderton

(57) ABSTRACT

Impact shredder hammers having first and second major surfaces on opposing sides, and a circumferential edge. A mounting portion includes a mounting hole that extends from the first major surface to the second major surface, and is configured to receive a hammer mounting pin for mounting in a reducing system. A distal portion includes a primary impact face to initially impact materials to be reduced and a wear edge to subsequently compress, crumble, and/or shear the material against a wall of the equipment. The hammer is provided with a plurality of alternating protrusions and recesses in the distal portion.

26 Claims, 12 Drawing Sheets

STEPPED SHREDDER HAMMERS

RELATED APPLICATION

This application claims priority benefits to U.S. Provisional Patent Application No. 61/904,130 filed Nov. 14, 2013 and entitled "Stepped Shredder Hammers," which is incorporated herein by reference in its entirety.

FIELD OF THE INVENTION

The present invention relates to industrial reducing machines. More particularly, this invention relates to reducing machines that include shredder hammers.

BACKGROUND OF THE INVENTION

Industrial shredding equipment or reducing machines typically are used to break large objects into smaller pieces that can be more readily processed, for example as in the recycling industry. Commercially available reducing machines range in size from those that reduce materials like rubber (e.g., car tires), wood, and paper to larger reducing machines that are capable of reducing scrap metal, automobiles, automobile body parts, and the like.

The core of most industrial reducing machines is the reducing chamber, where multiple hammers, sometimes referred to as shredder hammers, are spun on a rotary head, and repeatedly impact the material to be reduced against an anvil or other hardened surface. Hammers are therefore routinely exposed to extremely harsh conditions of use, and so typically are constructed from hardened steel materials, such as low alloy steel or high manganese alloy content steel (such as Hadfield Manganese Steel). Shredder hammers may each weigh several hundred pounds (e.g., 150 to 1200 lbs.), and during typical shredder operations these heavy hammers slam into the material to be shredded at relatively high rates of speed. Even when employing hardened materials, the typical lifespan of a shredder hammer may only be a few days to a few weeks. In particular, as the shredder hammer blade or impact area undergoes repeated collisions with the material to be processed, the material of the shredder hammer itself tends to wear away.

It should be appreciated that the greater throughput that the shredding equipment can process, the more efficiently and profitably the equipment can operate. Accordingly, there is room in the art for improvements in the structure and construction of shredder hammers and the machinery and systems utilizing such hammers.

Examples of shredder hammers and industrial reducing machines are disclosed in U.S. Pat. No. RE14865, U.S. Pat. No. 1,281,829, U.S. Pat. No. 1,301,316, U.S. Pat. No. 2,331,597, U.S. Pat. No. 2,467,865, U.S. Pat. No. 3,025,067, U.S. Pat. No. 4,049,202, U.S. Pat. No. 4,310,125, U.S. Pat. No. 4,373,679, U.S. Pat. No. 6,102,312 and U.S. Pat. No. 7,325,761. The disclosures of these and all other publications referenced herein are incorporated by reference in their entirety for all purposes.

SUMMARY OF THE INVENTION

The invention includes impact hammers having a proximal portion, a distal portion, a first and second major surfaces on opposing sides, and a circumferential edge. The proximal portion defines a mounting aperture extending through the hammer to receive a hammer mounting pin to mount the hammer to the reducing machine. The distal portion has a primary impact face to initially impact the material to be shredded and a wear edge with multiple locations to subsequently compress, crumble, and/or shear the material to be reduced. The distal portion of the hammer includes alternating protrusions and recesses.

In one aspect of the invention, the hammer includes a mounting portion with first and second major surfaces, and a working portion with outer surfaces and recessed surfaces. The outer surfaces on one side correspond to recessed surfaces on the other side. The outer surfaces on opposite sides define a nominal thickness that is greater than the thickness between the first and second major surface, but the thicknesses extending between the corresponding recessed and outer surfaces are generally the same as the thickness between the first and second primary surfaces.

In one other aspect of the invention, the working portion or distal portion of the hammer at the wear edge is stepped with seriate recesses and protrusions on both major surfaces providing a rippled or corrugated hammer body. The transition between adjacent recesses and protrusions provide faces or steps that engage material to be separated during operation.

In another aspect of the invention, a cross section thickness at any point along the wear edge is less than the nominal thickness of the hammer.

In another aspect of the invention, the proximal portion has a cross-sectional thickness measured at the mounting aperture from the first major surface to the second major surface of the hammer. The distal portion has a cross sectional thickness. The cross-sectional thickness of the distal portion is greater than the cross-sectional thickness of the proximal portion.

In another aspect of the invention, the first major surface and the second major surface include alternating protrusions and recesses in the distal portion.

In another aspect of the invention, an impact hammer includes a first major surface, a second major surface, a proximal portion, and a distal portion. The proximal portions has a mounting aperture extending through the first major surface to the second major surface to receive a hammer mounting pin to mount the impact hammer to the reducing machine. The distal portion has a primary impact face to initially impact the material to be reduced and a wear edge with multiple locations to subsequently compress, crumble, and/or shear the material to be reduced. The wear edge includes alternating protrusions and recesses along the wear edge. The protrusions and recesses extend from the wear edge inward toward the proximal portion.

In another aspect of the invention, the hammer includes a pair of major surfaces and a circumferential surface connecting the major surfaces. A hole extends through the hammer and opens in each of the major surfaces to receive a support pin for mounting the hammer in the reducing machine. A working or distal portion of the hammer is remote from the hole and includes a protrusion on the first major surface corresponding to and is opposite a recess on the second major surface and a recess adjacent the protrusion on the first major surface that corresponds to and is opposite a protrusion adjacent the recess on the second major surface.

In accordance with another aspect of the invention, the hammer includes a mounting hole opening in opposite first and second major surfaces of the hammer. The hammer has an overall transverse thickness determined by the furthest spaced surfaces defining the first and second major surfaces of the hammer, and actual thickness that is less than the overall transverse thickness of the hammer in at least a substantial portion of the working portion of the hammer.

In an additional aspect of the invention, the stepped profile of the hammer provides improved processing and material properties for the hammer. Solidification of the metal during the casting processes requires cooling at an adequate rate to limit separation of the alloy components into detrimental grain structures with undesirable material properties. Increased surface area, a reduced metal volume, and section thickness in the working portion increases convective cooling rates conducive to resilient metallurgical structures.

In another aspect of the invention, the invention includes reducing machines or shredding systems, where the reducing machine includes a rotary head, a reducing chamber enclosing the rotary head, and a plurality of hammers pivotally coupled to the rotary head. Each hammer includes first and second major surfaces on opposing sides, a circumferential edge, a proximal portion and a distal portion. The proximal portion of each hammer defines a mounting aperture to receive a hammer mounting pin and the distal portion of at least one hammer includes alternating steps and recesses on each of the first and second major surfaces. In one preferred construction, the reducing chamber includes a material inlet and an anvil near the material inlet so that the material to be reduced is initially impacted between the anvil and the impact hammers.

The working portion of the hammer includes the wear edge and the section of the hammer proximate to the wear edge with a primary contact face for impacting target materials to be separated. The working portion is subject to wear during operation and is a sacrificial part of the hammer.

Other aspects, advantages, and features of the invention will be described in more detail below and will be recognizable from the following detailed description of example structures in accordance with this disclosure.

DETAILED DESCRIPTION OF THE INVENTION

Hammers in reduction systems operate at very high speeds to impact and separate materials into smaller portions allowing them to be further processed in downstream operations. The hammers are mounted to a head and are rotated inside a housing. The target material is initially impacted by a face of the hammer passing an anvil near the material inlet. The target material is further reduced in size as the materials are shredded and compressed between the wear edge of the hammer and walls of the reducing system as well as by other impacts by and between the hammers. The walls are partially defined by heavy grates with openings that allow the material to exit when small enough to pass through the grate opening. The hammer, still rotating at high speed, compresses, crumbles, and shears the target material against the grates as it passes.

Figure 1:
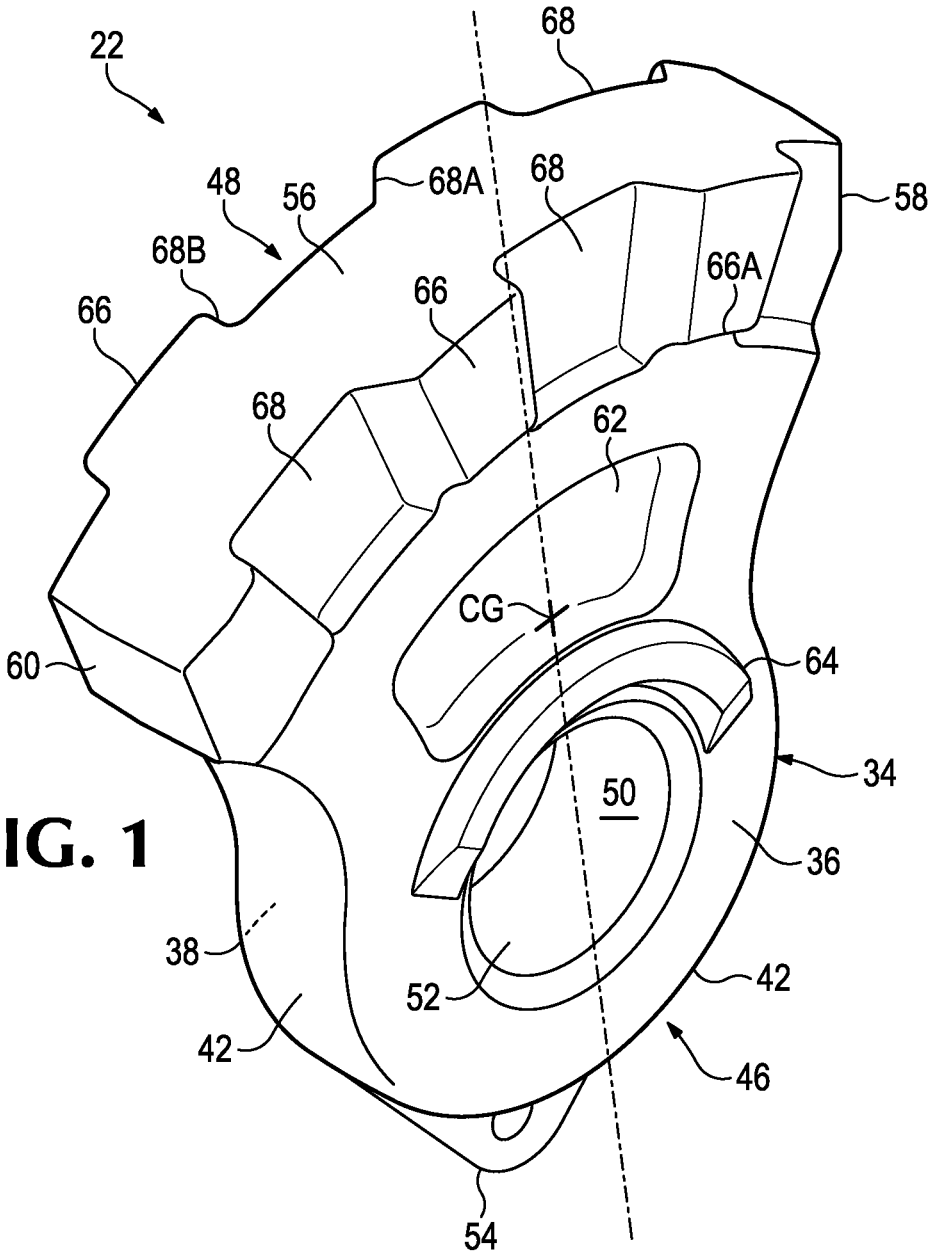
FIG. 1 is a front perspective view of a shredder hammer according to an exemplary embodiment of the present invention.
Figure 2:
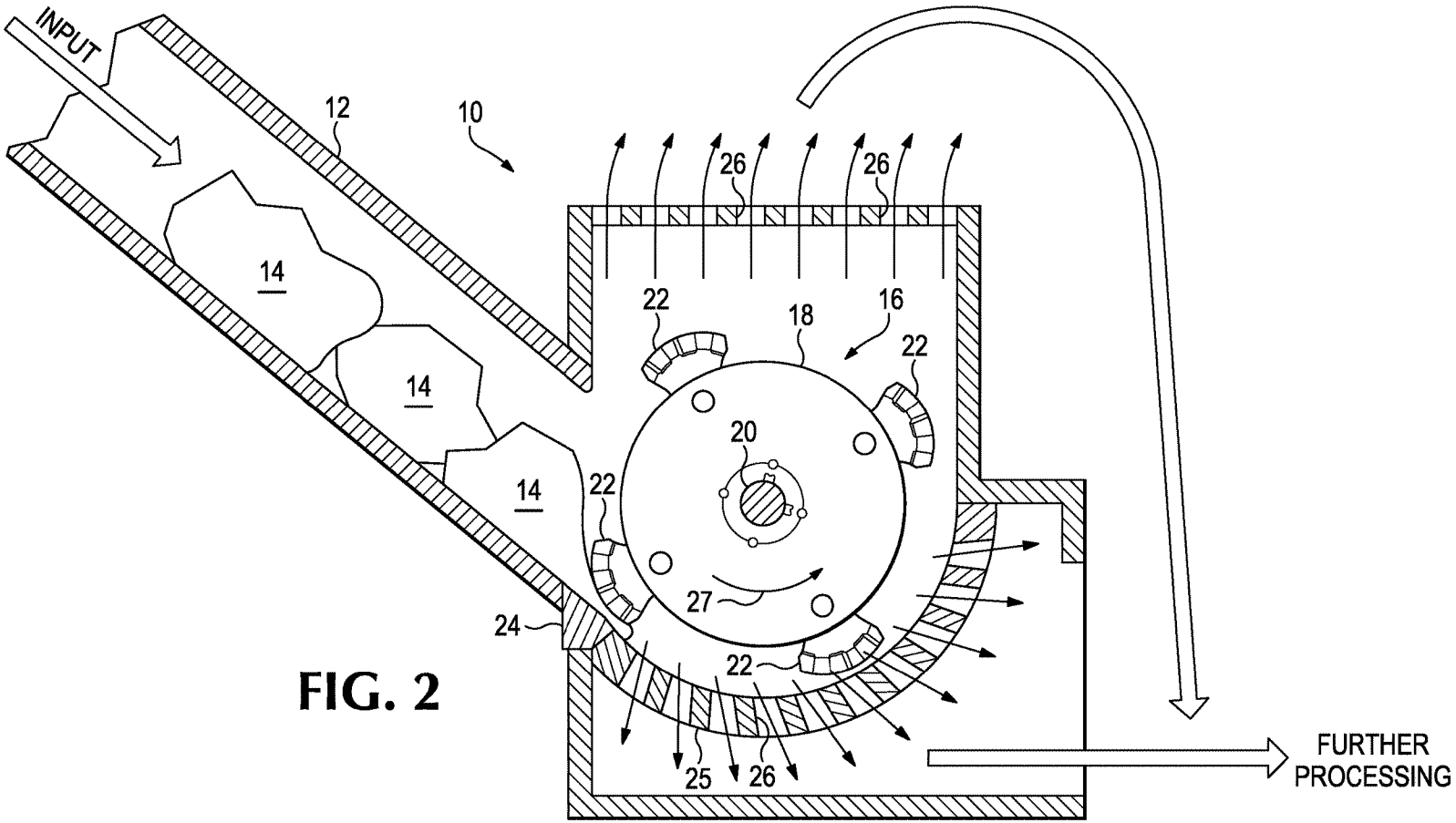
FIG. 2 is a schematic depiction of a shredding system according to an exemplary embodiment of the present invention.

FIG. 2 schematically illustrates an exemplary industrial reducing machine or shredding system 10. The typical components of such a shredding system include a material intake (such as chute 12) that introduces material 14 to be reduced or shredded to a reducing chamber or shredding chamber 16. The material 14 to be reduced may be of any desired size or shape. The material 14 is optionally pretreated, such as by heating, cooling, crushing, baling, etc. before being introduced into the reducing chamber 16. The material intake 12 may optionally include feed rollers or other machinery to facilitate feeding material 14 to chamber 16, and/or to control the rate at which material 14 enters chamber 16, and/or to prevent the material 14 from moving backward up the chute 12.

Within shredding chamber 16 is a rotary head 18 or rotary shredding head. Although the disclosure depicts a rotor or rotary shredding head, it should be appreciated that there are a variety of rotor configurations, including disc rotors, spider rotors, barrel rotors, and the like, that may also be used in the present shredding systems. Rotary shredding head 18 is equipped with at least one and preferably a plurality of hammers or shredder hammers 22 according to the present invention, and is configured to rotate about a shaft or axis 20. Hammers 22 each include a mounting hole or eye that closely receives the mounting shaft 20.

The configuration of the wear edge on a typical symmetric hammer reflects the circumference of rotation of the hammer around the pin. This circumference of rotation is smaller than the curvature of the grates which correspond to the circumference of rotation of the head with a set of hammers.

Each hammer 22 is independently pivotally mounted to the rotary head, so that as head 18 rotates, centrifugal forces acting on the hammers 22 urges each hammer to extend outward, tending toward a position where the center of gravity of each hammer is as far as possible from rotation axis 20.

With no introduced material in the housing of the reduction system, the head with the hammers rotates at operating speeds. The hammers are typically free to rotate closely about the mounting pins with little to no room for vertical or horizontal movement during operation. In the unloaded state under centrifugal force the hammers extend directly away from the axis of rotation (with some variation due to air friction in the chamber). In response to material entering the shredding system, the hammers deflect and rotate around the mounting pins as the hammers impact the material and against the grates.

In this way, as rotary shredding head 18 rotates, the shredder hammers impact the material 14 to be shredded, and compress, crumble, and shear material 14 by impact between hammers 22, an anvil 24 and the grates to break the material apart. Because the shredder hammer 22 is rotatably mounted on the mounting pin 32, contact with the material 14 to be shredded may cause the shredder hammer 22 to slow down or even rotate around the pin on account of impacting the material 14 to be shredded.

The resulting shredded materials may be discharged from the shredding chamber 16 through any one of the outlets 26 leading from the shredding chamber. As shown in FIG. 2, suitable outlets 26 may be provided in the bottom, top, and/or one or more sides of the chamber walls or in grates 25. The shredded material may then be transported for collection and/or further processing.

Figure 3:
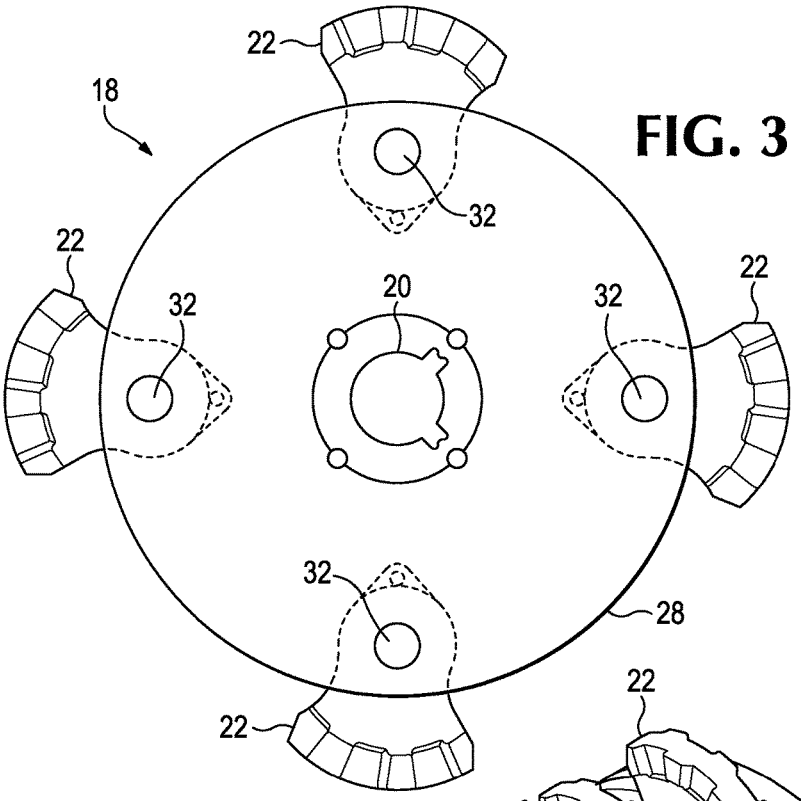
FIG. 3 is a front elevation view of a rotary shredding head according to an exemplary embodiment of the present invention.
Figure 4:
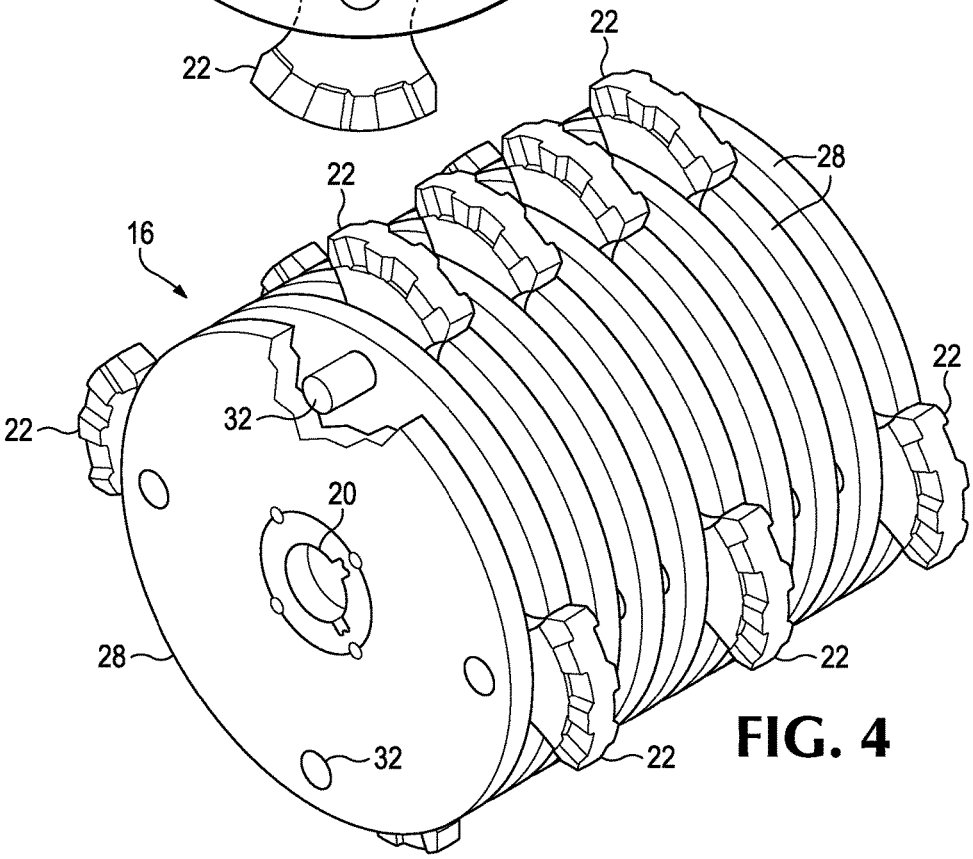
FIG. 4 is a perspective view of the rotary shredding head of FIG. 3 according to an exemplary embodiment of the present invention.
Figure 6:
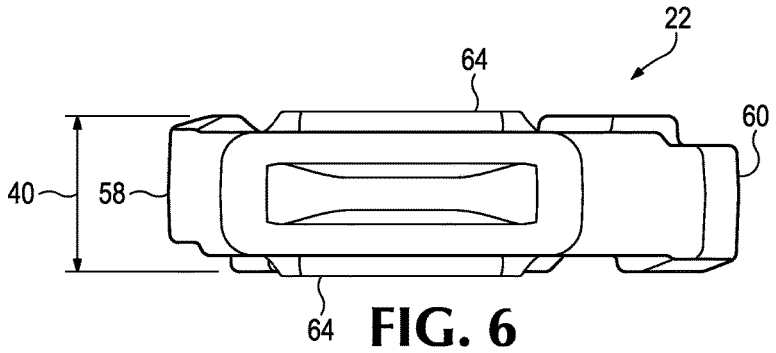
FIG. 6 is a top view of a shredder hammer according to an exemplary embodiment of the present invention.
Figure 7:
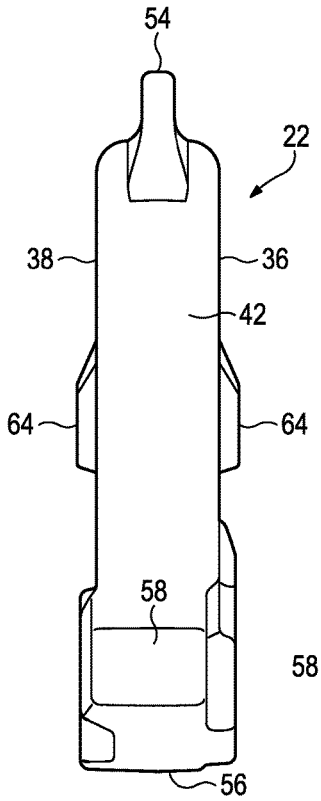
FIG. 7 is a side view of a shredder hammer according to an exemplary embodiment of the present invention.
Figure 5:
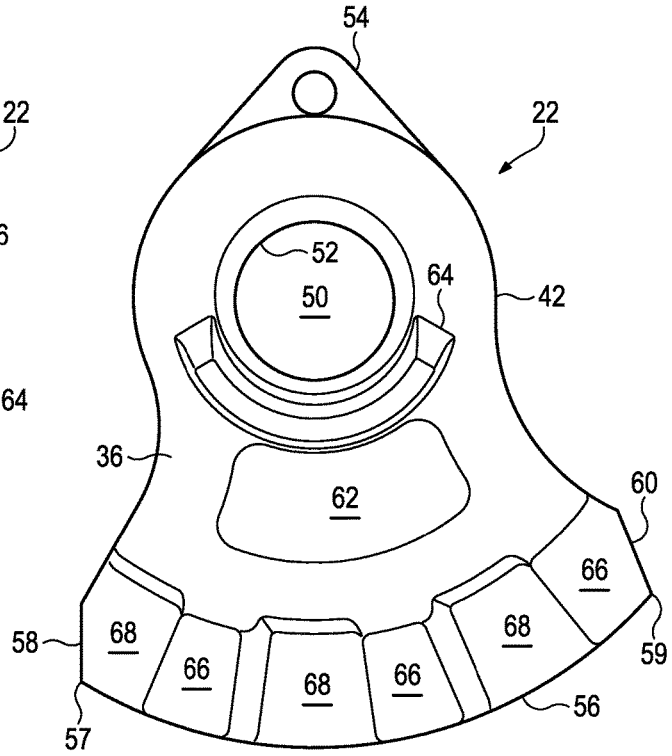
FIG. 5 is a front elevation view of a shredder hammer according to an exemplary embodiment of the present invention.
Figure 8:
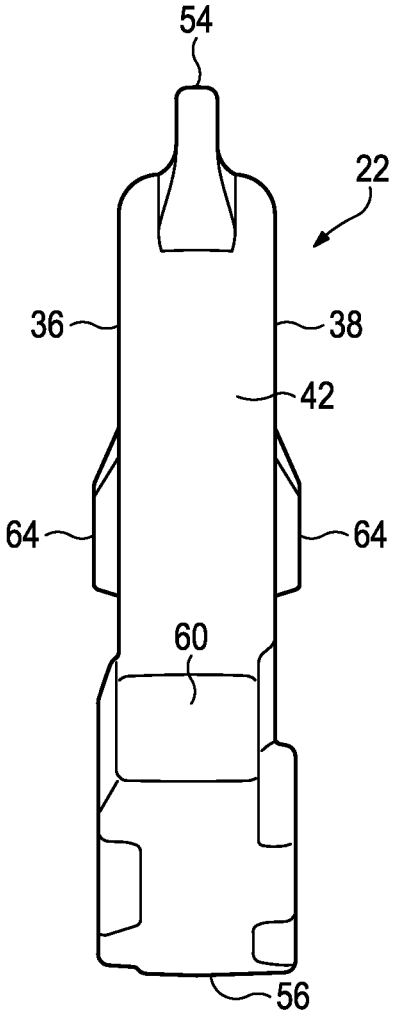
FIG. 8 is a side view of a shredder hammer according to an exemplary embodiment of the present invention.
Figure 9:
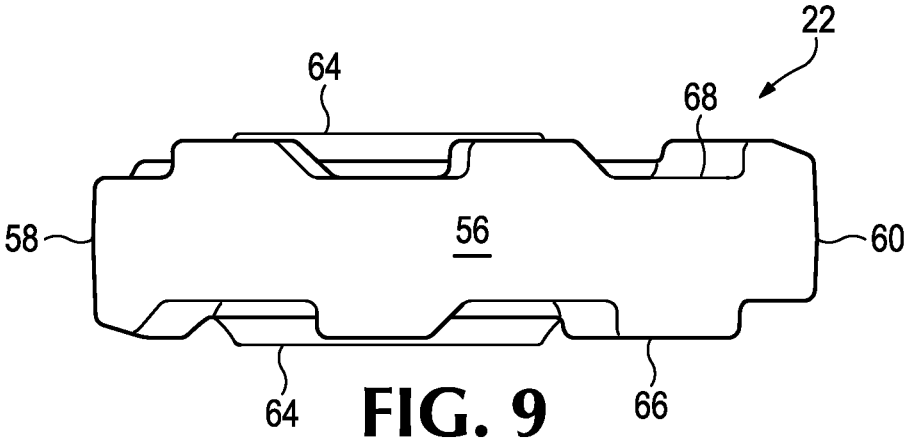
FIG. 9 is a bottom view of a shredder hammer according to an exemplary embodiment of the present invention.

The wide variety of applications for these shredding machines, from clay processing to automobile shredding, results in a wide range and variety of shredder configurations. FIG. 3 shows one typical example of a shredding head 18. Rotary shredding head 18 includes a plurality of rotor disks 28 that are separated from one another by spacers that are configured to be mounted around the drive shaft 20. While any number of rotor disks 28 may be utilized in a rotary shredding head, the illustrated example of shredding head 18 includes ten disks 28. Disks 28 are fixedly mounted with respect to the shaft 20, for example by welding, mechanical coupling, etc., to allow the disks 28 to be rotated when shaft 20 is rotated by an external motor or other power source (not shown). In addition to providing a spacing function, spacers can also help protect the shaft 20 from damage, due to contact with material 14 as it is being shredded, or fragments of broken shredder hammers 22, and the like.

The rotary shredding head 18 further includes a plurality of hammer mounting pins 32 that extend between at least some of the rotor disks 28 and/or through the entire length of the shredding head 18. The shredder hammers 22 are rotatably mounted on the hammer mounting pins 32 so that they are capable of freely and independently rotating around the mounting pins. In this illustrated example, the shredding head 18 includes four mounting pins 32 around the circumference of the rotor disks 28, and shredder hammers 22 are shown mounted on selected pins 32 between each adjacent pair of rotor disks 28. It is recognized that three, four or more hammers can be mounted between adjacent disks depending on the specific application. The particular distribution of hammers may be modified as required, although the hammers are typically positioned so that the shredding head is balanced with respect to rotation.

The mounting pins 32, shredder hammers 22, and rotor disks 28 may be structured and arranged so that, in the event that a shredder hammer 22 is unable to completely pass through the material 14, it can rotate to a location between adjacent disks 28 and thereby pass by the material 14 until it is able to extend outward again under the effect of the rotation of the shredder head 18. In certain embodiments, or in addition, the shredder hammer 22 may shift sideways on its mounting pin 32 with little or no vertical motion as it passes by or through the material 14 to be shredded. If desired, the various parts of the shredder head 18 may be shaped and oriented with respect to one another such that a shredder hammer 22 can rotate 360° around its mounting pin 32 without contacting another mounting pin 32, the drive shaft 20, another hammer 22, etc. Alternatively, a raised portion on one or both of the major surfaces proximate to the hole acts to center the hammer between the disks 28.

An impact shredding hammer 22 of the present invention is depicted in FIG. 1 and FIGS. 5-15. Hammer 22 has a proximal or mounting portion 46 and a distal or working portion 48. The proximal portion 46 of hammer 22 may include a lifting eye 54. The lifting eye 54, when present, is typically disposed on the circumferential edge 42 along the mounting portion. The lifting eye 54 may be used to facilitate the handling and movement of the shredder hammer 22, which may be both extremely heavy and relatively unwieldy. In general, the working portion of the hammer is the outer portion that tends to do more of the shredding operation, and the mounting portion is the inner portion that mounts the hammer to the head.

The working portion 48 of hammer 22 includes wear edge 56 at the distal surface of circumferential edge 42. Wear edge 56 faces outward and opposes grates 25 when rotating in an unloaded condition. The wear edge works with the grates to shred the material. In this embodiment, the wear edge 56 is defined as a convex arc along the distal edge of hammer 22. The shape of wear edge 56 as a convex arc helps prevent any undesired contact between the shredder hammer 22 and the wall of shredding chamber 16 or the anvil 24 as the shredder hammer rotates around mounting pin 32. An arcuate wear edge enables maximization of the mass in the working portion to increase the energy as the hammer spins about to pin to impact the material to be shredded. The arcuate wear edge still permits the required clearance for the hammer to rotate about mounting pin 32. An arcuate wear edge also provides cooperation with the grate to effectively break up the material fed into the machine. The wear edge may be an arc of a circle defined by a radius or defined by a plurality of radii or by a continually changing arc. The arc is preferably defined by a radius with a center of curvature that is at or near the center of mounting hole 50 (i.e., at or near the axis of rotation of the hammer and the center of pin 32). Alternatively, the wear edge can be formed with planar or irregular surfaces or segments. The wear edge may be interrupted by recesses or slots through the hammer. The wear edge could also be planar or could have an irregular shape.

Shredder hammer 22 is a generally plate-like hammer body 34 with a mounting portion 46 for securing the hammer in a machine, and a working portion 48 to primarily impact and engage the material to be reduced in the machine. The mounting portion 46 has a first major surface 36 and a second major surface 38 that define opposite sides of the hammer. First and second major surfaces 36, 38 are generally parallel to each other and define a thickness there between (i.e., the perpendicular distance between the first and second major surfaces.) Ridges, projections, recesses and the like may be formed or provided in or on the first and second major surfaces. The thickness between the first and second major surfaces 36, 38 is considered apart from such ridges, projections, recesses and the like. The mounting portion 46 of hammer 22 includes and defines a mounting aperture or opening 50 that is configured in size and shape to closely receive the hammer mounting pin 32 in order to rotatably mount the shredder hammer to the rotary shredding head 18. The mounting aperture typically extends from the first major surface 36 to the second major surface 38 of the hammer, and forms a passageway through the hammer 22. The interior surface 52 of mounting aperture 50 may be varied and in a form that is compatible with the desired mounting pin and rotary shredding head with which the shredder hammer is intended to be used. The interior surface 52 of mounting aperture 50 generally matches the exterior surface of the mounting pin. Interior surface 52 may be shaped so that the mounting aperture 50 is approximately cylindrical. Alternatively, the interior surface 52 of mounting aperture 50 may define one or more curving surfaces, such as are described in U.S. Pat. No. 8,308,094 incorporated herein by reference in its entirety. A longitudinal axis 44 is defined between the center of the opening 50 and a center of gravity of the hammer.

The shape of the hammer is largely defined by a circumferential edge 42 which extends between the first and second major surfaces 36, 38 and includes wear edge 56. The circumferential edge 42 is typically substantially perpendicular to at least one of the planes defined by the first major surface 36 or second major surface 38, or is substantially perpendicular to both the first major surface 36 and second major surface 38. The circumferential edge typically includes a plurality of edge segments, including one or more curved edge segments, so as to define the overall outline of the hammer. In a preferred embodiment of the present invention, the outline of the hammer is generally bell-shaped in plan view as defined by the circumferential edge 42 with a working portion that is wider than the mounting portion. In this embodiment, the wear edge is curved from the impact face 58 to trailing face 60. The shape could be different. For example, in another embodiment of the present invention, the distal portion of the circumferential edge 42 is made up of a series of linear faces that intersect one another.

Circumferential edge 42 includes wear edge 56 to oppose the grates, and a leading impact face 58 which faces forward to strike material fed into the machine. While leading impact face 58 could have a variety of orientations, it preferably extends generally in the direction of the longitudinal axis 44. Impact face 58 is preferably generally planar but could have a rounded or other configuration. A trailing face 60 defines a second or secondary impact face to permit reversible mounting of the hammer after the leading portion of the working portion 48 wears away, but a second impact face is not necessary. Leading and trailing faces 58, 60 connect with the leading and trailing ends 57, 59 of wear edge 56. The leading impact face extends generally from the wear edge 56 inward toward the mounting hole (i.e. generally in the direction of the longitudinal axis 44). The impact face 58 faces in the direction of rotation of the rotary shredding head 18 to provide a blunt face to strike the materials fed into the machine. The trailing face 60 at trailing end 59 of the wear edge 56 permits reversible mounting of the hammer when the leading portion of the working portion 48 wears away.

Shredder hammer 22 includes shoulders 64 on major surfaces 36, 38. The shoulders are predominantly in a mounting portion proximate mounting hole 50 and spaced from wear edge 56. The shoulder can contact disk 28 and maintain the hammer in position on the mounting shaft 32.

The working portion 48 of hammer 22 includes recesses 68 and protrusions 66 on major surfaces 36, 38. The recesses 68 and the protrusions 66 preferably do not overlap, however, in some embodiments the recesses and protrusions may overlap. The protrusion and recesses are predominantly in a working portion and the recesses open to surface 36 or 38 and wear edge 56. Working portion 48 includes at least one recess 68 on each of the first and second sides aa, bb. The first and second sides aa, bb of the working portion 48 are defined by recessed surfaces cc and outer surfaces dd that generally face in the same directions as the first and second major surfaces 36, 38 of mounting portion 46. The outer surfaces dd define a nominal thickness that is greater than the thickness between the first and second major surfaces 36, 38. The nominal thickness is the perpendicular distance between the planes generally coplanar with the outer surfaces dd. Each other surface dd is generally transversely aligned with a recessed surface cc on the opposite side of the working portion 48 of the hammer. Each of these transversely aligned outer and recessed surfaces will be referred to as corresponding outer and recessed surfaces. The thickness between any of the corresponding outer surfaces dd and recessed surfaces cc are the same or less as the thickness between the first and second major surfaces 36, 38. The provision of such corresponding recessed surfaces and outer surfaces along the working portion enables the working portion to possess a greater nominal thickness with an actual thickness at any location being the same or less than the thickness between the first and second major surfaces of the mounting portion. Such a construction improves the quality and efficiency of the cast hammers particularly for steel cast hammers.

Accordingly, the cross-sectional thickness of the distal portion is greater than the cross-sectional thickness of the proximal portion to increase the surface area within the working portion of the hammer. The transitions between protrusions and recesses provide steps on the working portion of the hammer further grip and engage the target material, improving throughput and separation. Additional edges on one or both of the major surfaces of a shredder hammer advantageously act as auxiliary impact faces by increasing the surface area available for material contact, thereby enhancing the operational efficiency of the shredder hammer including output material density. Improved shredding of the materials enhances post-processing by providing efficient sorting of the ferrous and non-ferrous metals and other materials.

Though the forming of recesses in the major surfaces of the hammer removes material from the hammer, work hardening due to additional material impacts, especially at recess edges, extend the work hardening more deeply into the hammer body with a high manganese steel alloy. As a result a larger percentage of the volume of the hammer body has improved operational material characteristics.

Protrusions 66 on major surface 36 and major surface 38 in the working portion define a nominal thickness 40 of the hammer. The cross section thickness of the hammer preferably varies substantially at different points or areas of the hammer body. The faces of the recesses and protrusions are preferably planar, but may be curved or formed by a plurality of planar faces. The walls of the recesses typically include an upstream wall 68A and a downstream wall 68B defined by its orientation to an impact face 58 or the flow of material during operation. The upstream and downstream walls on each side of a recess 68 are opposed to each other.

The upstream and downstream walls may be inclined to each other diverging in a direction away from the floor of recess 68 or parallel in extending from the floor of recess 68 or have other shapes. The upstream and downstream walls extending away from wear edge 56 may be parallel, may diverge or may converge (e.g. radially oriented relative to the center of mounting hole 50). Walls 68A and 68B largely define the recesses and separate each recess from adjacent protrusions.

Protrusion 66 includes a top wall 66A that is spaced from wear edge 56 and is between the protrusion and the main surface 36 or 38 of the hammer. Wall 66A is a transition between the protrusion and the main surface which is at a different level. Some walls 68A and 68B between recesses and protrusions form steps that are substantially perpendicular to the faces of the protrusions and recesses. Some transitions between adjacent recesses and protrusions are more gradual transitions forming bevels. Hammers including recesses, steps and transitions are described in more detail in U.S. patent application Ser. No. 13/789,031 incorporated herein by reference in its entirety. These various kinds of recesses and the like can be used with hammers in accordance with the present invention.

The beveled transition portion can be any configuration that provides a less abrupt and more extended transition from a protrusion to an adjacent recess. Here the transition is a planar surface that extends from the bottom of the recess to the protrusion surface at an obtuse angle to the protrusion surface. Again, the recess transition could be another configuration such as a rounded edge or a bevel that does not extend to the bottom of the recess. The transitions extend away from the wear edge toward the mounting portion and are preferably aligned along a radius between the wear edge and the hole. The edges of the bevel can converge extending away from wear edge 56. At least a portion of the recess transition preferably forms an obtuse angle to the surface of the hammer at the recess upstream edge.

Figure 15:
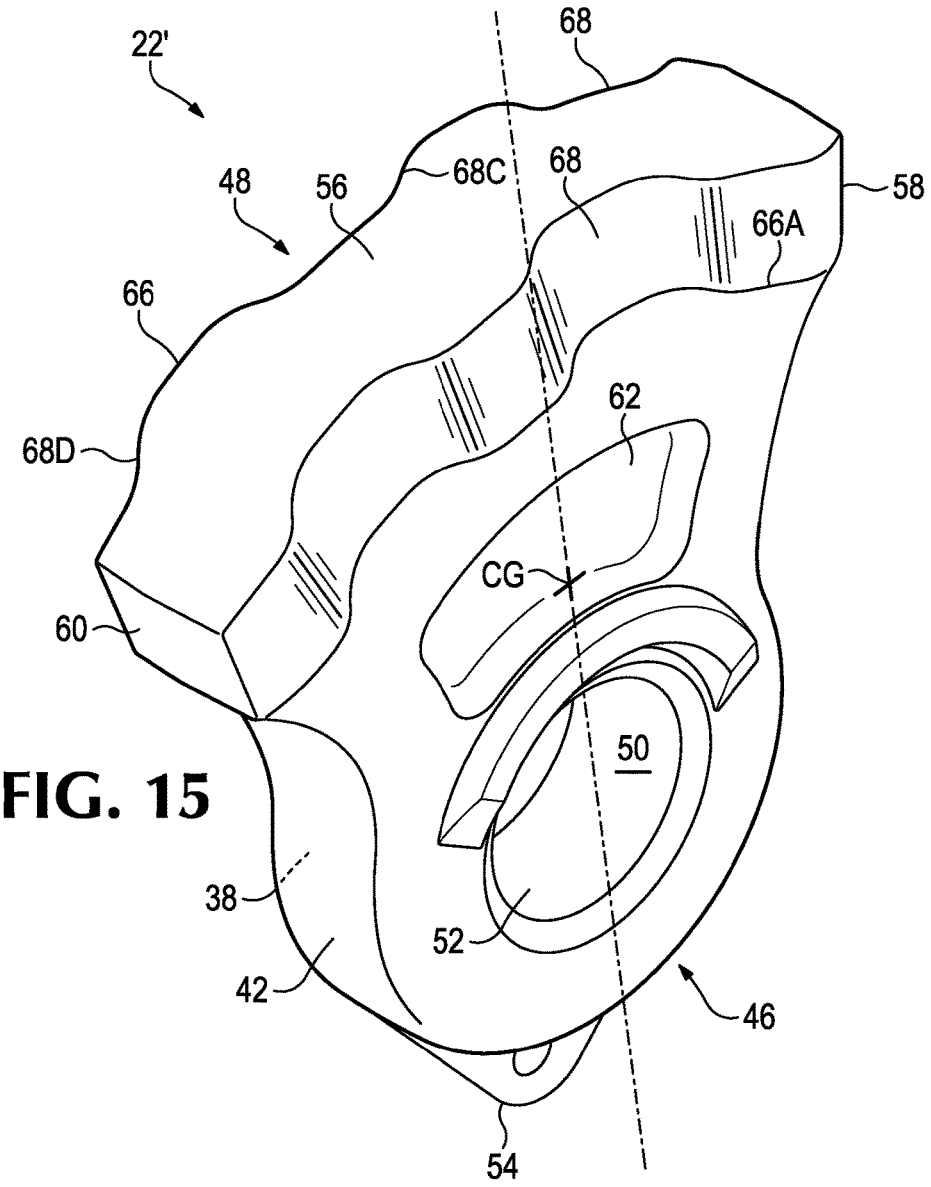
FIG. 15 is a front perspective view of a shredder hammer according to an exemplary embodiment of the present invention.

Other configurations for recesses and protrusions are possible. In an alternative configuration a hammer 22' is shown in FIG. 15 with protrusions and recesses 66 and 68 in the working portion 48 separated by curved leading and trailing steps 68C and 68D. Steps 68C and 68D extend away from wear edge 56 toward the mounting end 46 of hammer 22'. These transitions engage material in a similar way to walls 68A and 68B during operation. The hammer of this embodiment has similar advantages in manufacturing and material engagement as previously described. The hammer material cools at a faster and more even rate with preferred grain formation than a non-stepped hammer of similar nominal thickness.

Figure 10:
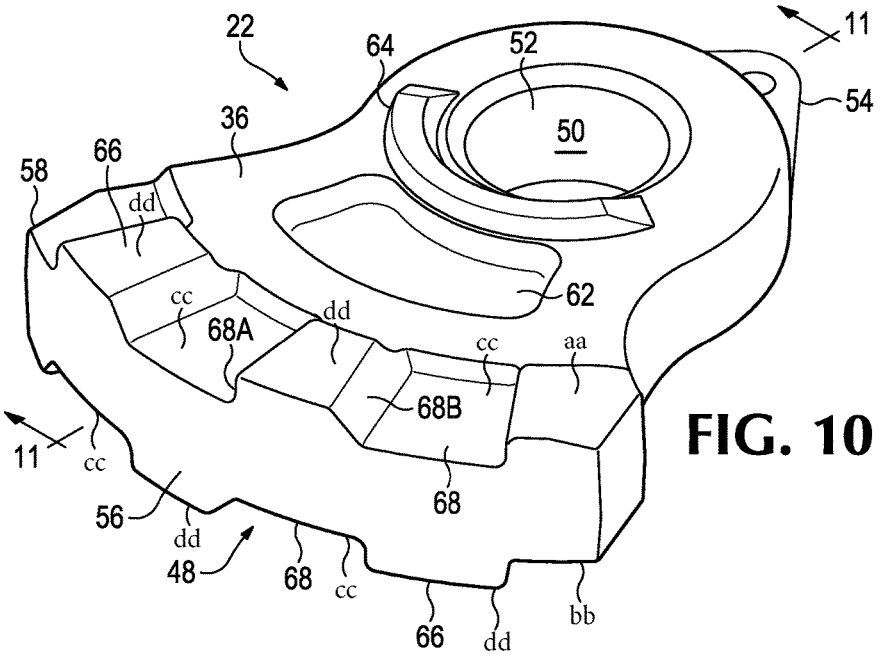
FIG. 10 is a front perspective view of a shredder hammer according to an exemplary embodiment of the present invention.
Figure 11:
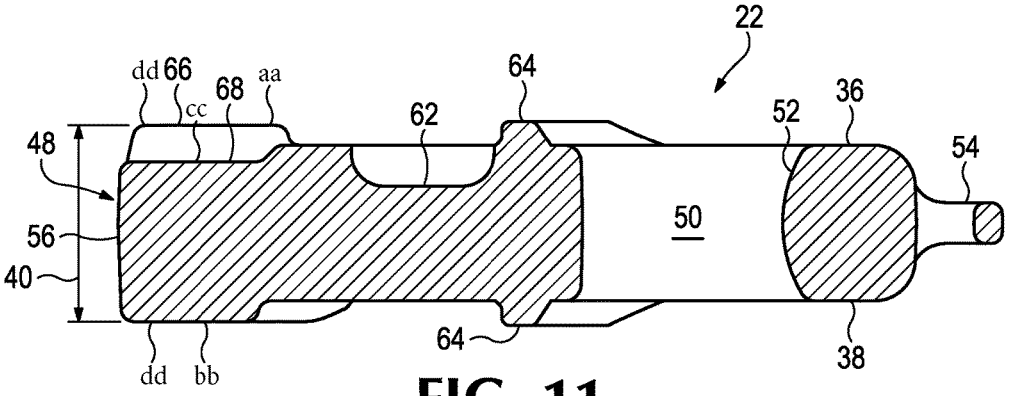
FIG. 11 is a cross section view of a shredder hammer as noted in FIG. 10.
Figure 12:
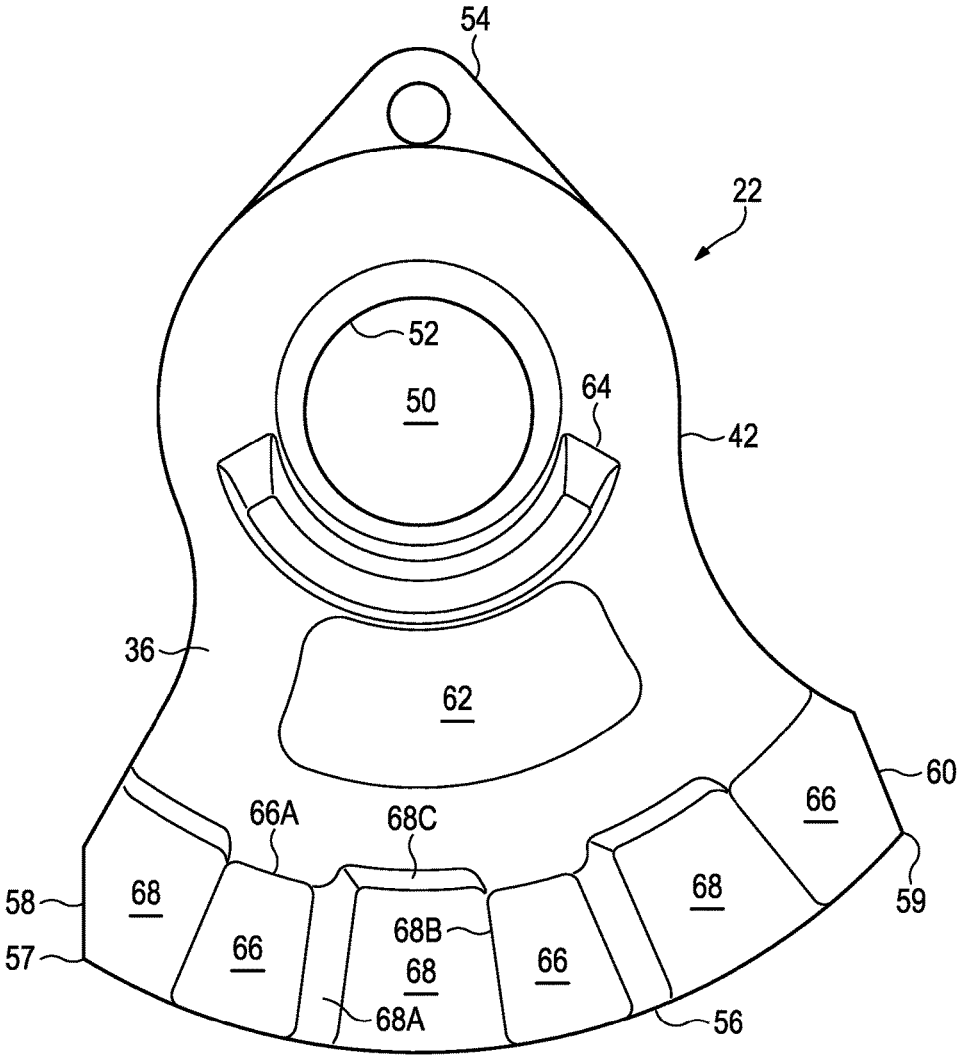
FIG. 12 is a front elevation view of a shredder hammer according to an exemplary embodiment of the present invention.

In another alternative embodiment similar to FIG. 10, walls 68A and 68B define a significant portion of the recess forming two faces inclined to each other and converging extending from the protrusions into the hammer. On the opposite side of the hammer each corresponding protrusion is significantly defined by walls 68A and 68B forming two faces inclined to each other and converging extending away from the recesses. In another alternative embodiment, each recess between adjacent protrusions may be defined by a continuous curve.

Many other variations are possible that still fall within the scope of this disclosure. While three protrusions and recesses are shown on each side of the hammer in the figures, more or fewer protrusions and recesses may be used. Different combinations of protrusion and recess configurations may be used. For example, in another alternative embodiment, some of the transitions between faces are walls 68A and/or 68B and some of the transitions are curved steps 68C and/or 68D.

Figure 16:
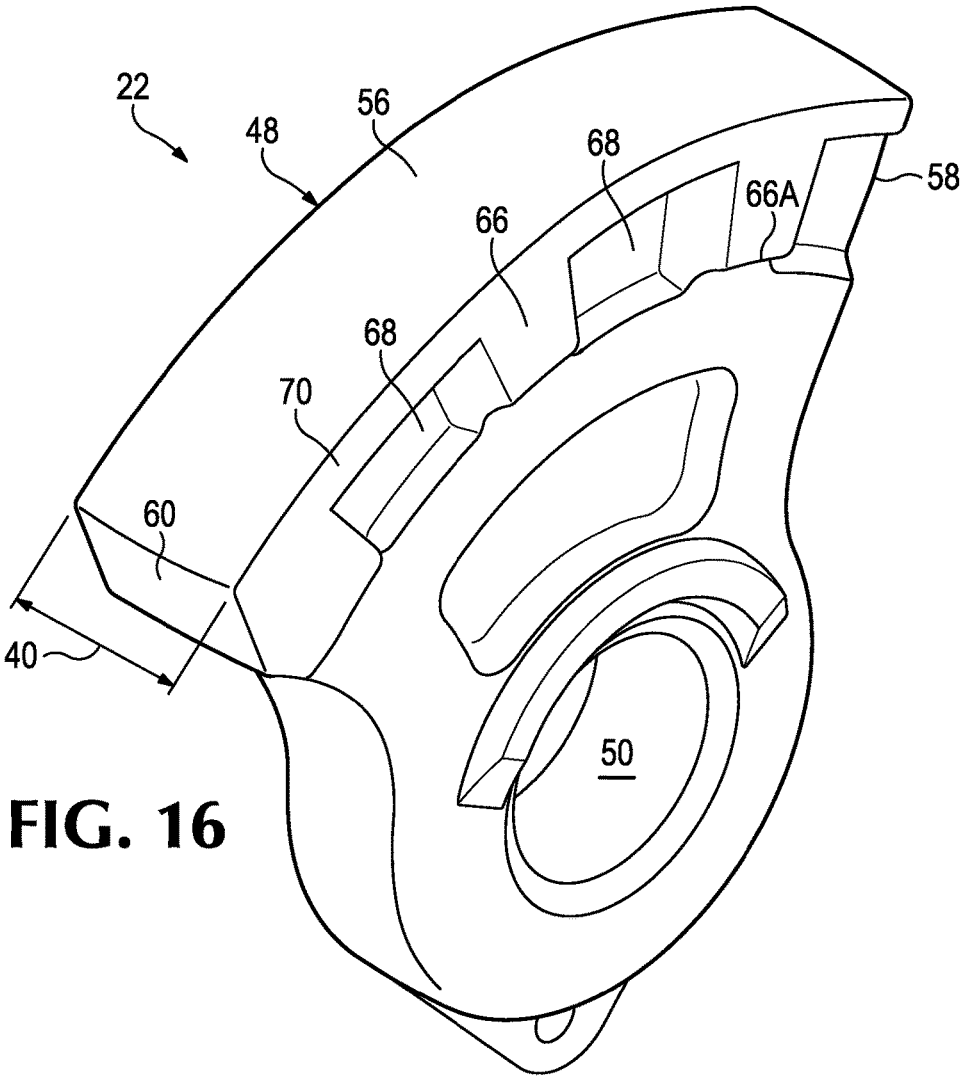
FIG. 16 is a front perspective view of a shredder hammer according to an exemplary embodiment of the present invention with a wall along the wear edge.

In some cases it may be advantageous to manufacture the hammer so that the shredding recesses (i.e., those predominately in the working portion) are proximate or adjacent to edge 42 but do not open to the edge as seen in FIG. 16. The hammer may be manufactured with a thin wall or partition 70 separating the edge 56 and the recesses so the recesses are spaced from wear edge 56 and the wear edge 56 is free of protrusions and recesses. The partition or thin wall 70 is shown spanning the nominal thickness 40 of the hammer. As the wall 70 is relatively thin, the same benefits are achieved with this embodiment as with the embodiment of FIG. 10. The wall 70 may also be advantageous to hammers that are dual heat treated or induction hardened as the material hardness within the thin wall 70 may be increased. When installed and initially operated, this partition is either worn away or quickly separates from the hammer providing the advantages of a recess on initial operation and through the service life of the hammer. All of the advantages of the recesses are realized in operation though the recesses are not initially open at edge 56. Alternatively, the shredding recesses can be completely open (i.e. through the entire thickness) for a span (such as along wear edge 56) so long as most of the recess extends only part way through the thickness of the hammer for sufficient strength and reliability.

Figure 17:
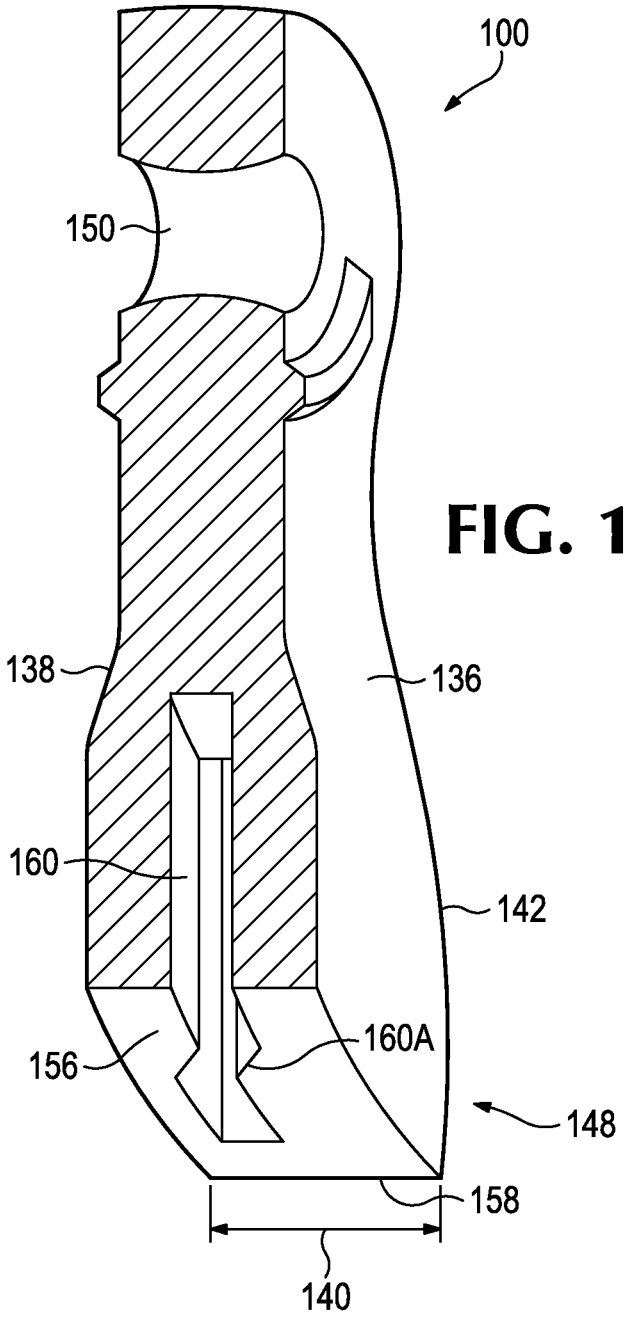
FIG. 17 is a perspective cross section view of a shredder hammer according to an exemplary embodiment of the present invention with a slot opening to the wear edge.

In an alternative embodiment, many of the advantages of the inventive hammer can be realized by the inventive hammer shown in FIG. 17. Hammer 100 has a first major surface 136 and a second major surface 138 that define opposite sides of the hammer and a nominal thickness 140 defined at the maximally spaced portions of surface 136 and 138 in the working portion. The hammer 100 includes and defines a mounting aperture or opening 150 that is configured to receive the hammer mounting pin. The shape of the hammer is largely defined by a circumferential edge 142 which extends between the first and second major surfaces 136, 138 and includes wear edge 156.

Shredder hammer 100 includes a slot 160 through hammer working portion 148 that opens along a substantial portion of the length of wear edge 156 and extends away from the wear edge toward opening 150. The slot 160 is generally along a plane that extends between the first major surface 136 and the second major surface 138. In one preferred embodiment, the first major surface 136 and the second major surface 138 are free of recesses, however, the first and second major surface could have recesses and protrusions similar to those discussed on hammers 22 and 22' previously discussed. The slot 160 is shown as having a lateral step 160A as it extends along the length of the wear edge and does not open to the impact face 158. The hammer has an effectively thinner cross section than a standard hammer and increased surface area afforded by the slot. The slot allows the hammer to cool evenly through the thickness of the hammer so formation of precipitates is limited with consistent material properties through the hammer. Alternatively, the slot is linear and extends along the length of the wear edge without interruption such as a step. Alternatively, the slot opens to one or both impact faces at the ends of the wear edge.

Hammer 22 can include additional recesses such as concavity 62 (FIGS. 1, 5, 10-12, and 15). Concavity 62 is predominately in the mounting portion 46 of the hammer, which reduces the overall weight of the hammer without substantial reduction in operational effectiveness. During operation, as the hammer spins at high speed, mass at the distal end travels at a much higher velocity with greater momentum than mass in the mounting portion. The reduction in mass at mounting end 46 has limited effect on the impact provided by the hammer and reduces the mass that is scrapped at the end of the service life of the hammer.

Figure 13:
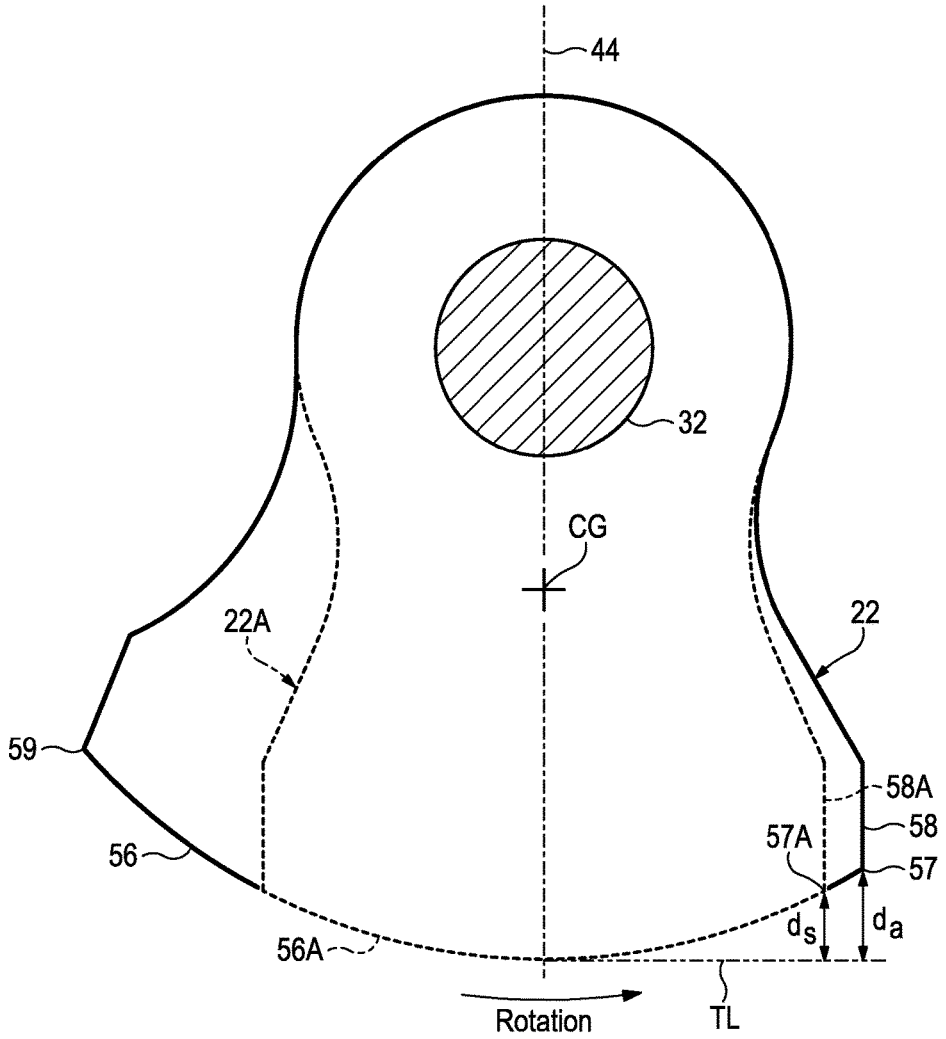
FIG. 13 is a front elevation view of a shredder hammer according to an exemplary embodiment of the present invention.
Figure 14:
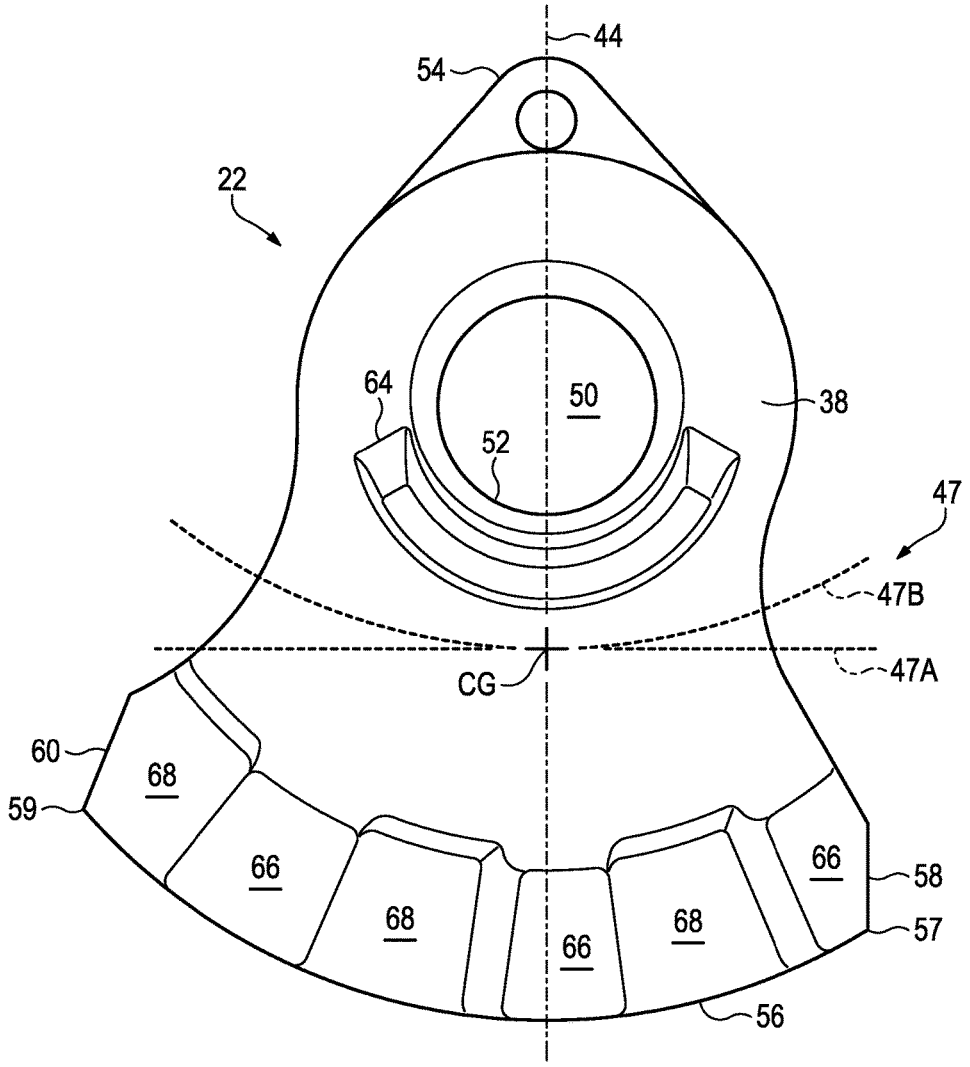
FIG. 14 is a back elevation view of a shredder hammer with longitudinal and transverse axes according to an exemplary embodiment of the present invention.

The present invention is appropriate for symmetric and asymmetric hammers. In one preferred embodiment the hammer is asymmetric as disclosed in US Patent Application Publication US-2014/0151475 incorporated herein by reference in its entirety. In an asymmetric hammer the wear edge defined by the circumferential edge is free from an axis of symmetry such that the hammer's center of gravity is closer to the trailing end of the hammer than the leading end of the hammer as the hammer rotates around the head (i.e., the center of gravity is rearward on the hammer from the center of gravity of a corresponding symmetric hammer). In response, the hammer rotates forward in the direction of rotation of the head on the mounting pin to provide a larger gap with more volume between the leading portion of the wear edge and the opposing grate than a symmetric hammer provides. Under load the asymmetric hammer with the offset center of gravity may still rotate around the pin in an opposite direction to the rotation of the head due to impacts and friction, but the acceptance gap under load is wider than is provided by the symmetric hammer under a similar load. An asymmetric hammer preferably has increased mass that displaces the hammer center of gravity away from the primary impact face 58 but the invention is also useful in asymmetric hammers where the mass is offset so that the center of gravity is closer to the leading end than the trailing end. FIG. 13 shows an asymmetric hammer with a superimposed symmetric hammer 22A. Both hammers hang from the pin in an unloaded condition so the centers of gravity CG are overlapped and directly below the center of the pin. The right leading or forward side of the asymmetric hammer reflects a similar outline to the symmetric hammer for illustration, but the hammers may have any outline. Both hammers reference the same center for mounting pin 32.

The trailing side of the asymmetric hammer has additional mass which displaces the center of gravity so that the center of gravity is closer to the trailing side than the leading side. In response the hammer rotates forward in the direction of rotation of the head on the pin and primary impact face 58 is displaced forward in the direction of rotation of the head when compared to the impact face 58A of the symmetric hammer. A transverse line TL extends perpendicular from the intersection of the longitudinal axis at the wear edge forward. The forward terminus 57 of wear edge 56 at the primary impact face of the asymmetric hammer is a greater distance $d_a$ from the transverse line TL than the corresponding point 57A on the symmetric hammer which is distance $d_s$ from the transverse line. This provides a wider opening or gap for accepting the target materials to be separated and reduced and increases efficiency of the system.

The distal or working portion of hammer 22 may be differentiated from the proximal end of the hammer by a transverse axis 47 perpendicular to the longitudinal axis and extending through the center of gravity CG, but could be positioned inward or outward of the center of gravity, i.e., the separation between the mounting portion and the working portion can be defined differently and may be different for different hammers. The transverse axis can be a line 47A or an arc 47B or other configuration that provides a differentiation of the two portions.

Shredder hammers used in the art of reduction systems typically are constructed from especially durable materials, such as hardened steel alloys. Materials suitable for the fabrication of shredder hammers include low alloy steel or high manganese alloy content steel, among others. The size of cast alloy steel components can be limited by solidification processes that can cause separation of alloy components and degradation of the material properties in the heavy section casting. Generally, hammers, and particularly low alloy steel hammers, are limited to about five inch thickness to allow the part to cool very quickly during solidification at an even rate and so it solidifies with a homogenous composition. The ability of the hammer to be thoroughly and rapidly cooled during heat treating processes is also critical to achieving superior mechanical properties. A slower cooling rate allows carbon and other constituents to precipitate out of the molten metal during solidification. As the outer portions of the casting solidifies toward the center the concentration of these non-iron constituents increases at the solidification front. The center of the casting which is the last to solidify then has a high concentration of these non-iron elements. Due to these elements, grains then form at the center of the casting with different properties than grains in the outer portion of the casting. This can result in reduced toughness of the material, less wear resistance and cracking of the material at the center. Rapid cooling of the casting limits precipitation so that the non-iron constituents are more evenly distributed through the casting with a more homogenous structure and consistent material properties. The use of casting molds incorporating recesses and protrusions with an increased surface area and increased cooling rate result in improved material properties during the casting process, in turn resulting in greater wear performance and reliability for the resulting shredder hammers. The faster cooling rates of this design also dramatically affect the quench processes during heat treating and allow for the material to be hardened to a substantially greater depth providing much increased wear resistance as the casting is worn away.

In addition to the advantages of the presently disclosed shredder hammers with respect to increased functional efficiency, the shredder hammers of the present invention may also offer advantages with respect to their manufacture. Although the recesses and concavities of the shredder hammers of the present invention may be machined into a shredder hammer body after casting, these features are preferably incorporated into the casting mold used to fabricate the shredder hammer from molten metal. The alternating protrusions and recesses at the working portion of the hammer provide a reduced cross section at the working portion for a nominal hammer thickness. The presence of recesses increase hammer surface area, which in turn increases cooling effects during casting and heat treating resulting in consistent metal grain structure and depth of hardness, particularly for large hammers (e.g., those of 4 inches of thickness or more). The increased surface area allows manufacture of a high quality thicker hammer than is possible with conventional hammer configurations without sacrificing material properties, particularly for steel hammers. This allows for a wider array of material options with properties to suit the desired application.

The hammer of the present invention can have a nominal thickness of six inches or more with limited alloy dissociation. For example, a hammer with an overall or nominal thickness of six inches may have a cross section of five inches measured across a step and recess on opposite surfaces. The stepped, corrugated configuration at the working end can provide a cross-section less than the six inch nominal thickness. The recited features of the disclosed shredder hammers are designed to improve freeze-off, solidification, quenching during the casting process, heat treatment to improve material and mechanical properties, and product reliability.

Cooling is an important factor during operation as well. The hammer spins at high speed in the shredder during operation to apply the significant impact and shear force required to separate the target materials. The frictional forces between the hammer and material in the shredder generate heat and operating temperatures in the shredder can reach 300° C. or more. The wear edge and working portion of the hammer where the greatest friction occurs can be significantly hotter which reduces hardness and effectiveness of the hammer when impacting target materials.

In the present invention, the heat in the hammer may be dissipated to the air passing over the surface of the hammer through forced convective cooling as the hammer rotates. The protrusions and recesses increase surface area of the hammer and the rate of convective cooling, and/or other forms of heat transfer, of the hammer may also be increased. The rough surface of the hammer created by the steps and protrusions also generates significant turbulence across the hammer surface when operating. This air turbulence may further increase the convective cooling rate, reducing operating temperature of the hammer and materials to increase efficiency.

Some hammer materials exhibit a tendency to flow under specific circumstances. A sharp edge of a recess where it transitions from a hammer protrusion to a recess wall at a right angle is subject to formation of generally undesired features. Under repeated impacts the material of the hammer face can deform and deflect to create an overhang extending partially or entirely over the recess that limits the size of or closes the recess opening. This can reduce the amount of material impacted by the downstream edge of the recess. Modifying the leading or upstream edge of the recess from a right angle to a more extended transition reduces the tendency to form these features. The beveled transition configuration is less likely to form a cornice, especially for hammer materials with a tendency to flow.

It should be appreciated that although selected embodiments of the representative shredder hammers are disclosed herein, numerous variations of these embodiments may be envisioned by one of ordinary skill that do not deviate from the scope of the present disclosure. This presently disclosed shredder hammer design lends itself to use for both manganese and alloy hammer types, and the resulting hammers are well suited to a variety of shredding applications beyond metal shredding and metal recycling.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

The invention claimed is:

1. A hammer for reducing material in a reducing machine comprising:

a mounting portion including a first major surface, an opposite second major surface, and a mounting aperture extending transversely through the mounting portion and opening in the first major surface and the second major surface to receive a mounting pin to mount the hammer to the reducing equipment, the mounting portion having a thickness that extends transversely between the first and second major surface;

a working portion distal from the mounting aperture and having a leading face to impact the material to be reduced, an opposite trailing face, a wear edge extending between the leading face and the trailing face, a first side and a second side opposite the first side, the first side facing in the same direction as the first major surface and the second side facing in the same direction as the second major surface, wherein the first side and the second side include alternating protrusions and recesses such that an overall thickness of the working portion is greater than the thickness of the mounting portion.

2. A hammer in accordance with claim 1 wherein the wear edge is free of recesses.

3. A hammer in accordance with claim 2 wherein a thin wall separates the wear edge and the said recesses so that the said recesses are spaced from the wear edge.

4. A hammer in accordance with claim 1 wherein the protrusions and recesses extend upward from where each of the first side and the second side meets the wear edge.

5. A hammer in accordance with claim 1 wherein each said protrusion is free of overlap with the said protrusions on the opposite side.

6. A hammer in accordance with claim 1 wherein the working portion has a minimum thickness measured from one of the protrusions on the first side to one of the recesses on the second side that opposes the one said protrusion on the first side, the minimum thickness is less than a nominal thickness of the hammer.

7. A hammer in accordance with claim 1 wherein each said recess is defined by opposing walls separating the recess from adjacent protrusions.

8. A hammer in accordance with claim 7 wherein the opposing walls are planar.

9. A hammer in accordance with claim 7 wherein the opposing walls diverge from each other as the opposing walls extend away from each said recess.

10. A hammer for reducing material in a reducing machine comprising:

a proximal portion including a first major surface, an opposite second major surface, and a mounting aperture extending transversely through the hammer and opening in the first major surface and the second major surface to receive a mounting pin to mount the hammer to the reducing equipment;

a distal portion having a leading face to impact the material to be reduced, an opposite trailing face, a wear edge extending between the leading face and the trailing edge, and a plurality of recesses and protrusions on opposite sides of the distal portion, wherein a cross section thickness at any point along the distal portion is less than a nominal thickness of the hammer.

11. A hammer in accordance with claim 10 wherein the wear edge is free of recesses.

12. A hammer in accordance with claim 11 wherein a thin wall separates the wear edge and the said recesses so that the said recesses are spaced from the wear edge.

13. A hammer in accordance with claim 10 wherein the said protrusions and said recesses extend upward from where each said side meets the wear edge.

14. A hammer in accordance with claim 10 wherein each said protrusion is free of overlap with the said protrusions on the opposite side.

15. A hammer in accordance with claim 10 wherein the distal portion has a minimum thickness measured from one of the protrusions on one of the opposing sides to the recesses opposing the said protrusion on the other opposing side, the minimum thickness is less than the nominal thickness of the hammer.

16. A hammer for reducing material in a reducing machine comprising:

a mounting portion including a first major surface, an opposite second major surface, and a mounting aperture for receiving a mounting pin to mount the hammer in a reducing machine, the mounting portion defining a mounting portion thickness extending transversely between the first major surface and the second major surface; and a working portion including a first side facing in the same direction as the first major surface of the mounting portion and a second side facing in the same direction as the second major surface of the mounting portion, each of the first and second sides including at least one outer surface and at least one recessed surface to define at least one recess on each of the sides, every outer surface on one side being transversely aligned with one recessed surface on the opposite side, the outer surfaces on the sides defining an overall thickness of the working portion, the overall thickness of the working portion being greater than the thickness of the mounting portion, and the transverse thickness between any transversely aligned recessed and outer surfaces being the same or less than the thickness of the mounting portion.

17. A hammer in accordance with claim 16 wherein the working portion includes an outward facing wear edge.

18. A hammer in accordance with claim 17 wherein the wear edge is free of recesses.

19. A hammer in accordance with claim 18 wherein a thin wall separates the wear edge and the said recesses so that the said recesses are spaced from the wear edge.

20. A hammer in accordance with claim 17 wherein the said protrusions and said recesses extend upward from where each said side meets the wear edge.

21. A reducing machine for reducing material, the reducing machine comprising:

a rotary head;

a reducing chamber enclosing the rotary head;

a plurality of hammers, each said hammer including a mounting portion including a first major surface, an opposite second major surface, and a mounting aperture extending transversely through the mounting portion and opening in the first major surface and the second major surface, the mounting portion having a first thickness that extends transversely between the first and second major surface; and a working portion distal from the mounting aperture and having a leading face to impact the material to be reduced, an opposite trailing face, a wear edge extending between the leading face and the trailing face, a first side and a second side opposite the first side, the first side facing in the same direction as the first major surface of the mounting portion and the second side facing in the same direction as the second major surface of the mounting portion, wherein the first side and the second side include alternating protrusions and recesses such that an overall thickness of the working portion is greater than the thickness of the mounting portion; and a plurality of mounting pins to fit in each said mounting aperture to pivotally couple each said hammer to the rotary head.

22. A reducing machine in accordance with claim 21 wherein the reducing chamber includes a material inlet and an anvil near the material inlet so that the material to be reduced is initially impacted between the anvil and the hammers.

23. A reducing machine in accordance with claim 21 wherein an interior surface of the mounting aperture within the hammer matches an exterior surface of the hammer mounting pin.

24. A reducing machine for reducing material, the reducing machine comprising:

a rotary head;

a reducing chamber enclosing the rotary head;

a plurality of hammers, each said hammer including a proximal portion including a first major surface, an opposite second major surface, and a mounting aperture extending transversely through the hammer and opening in the first major surface and the second major surface;

a distal portion having a leading face to impact the material to be reduced, an opposite trailing face, a wear edge extending between the leading face and the trailing edge, and a plurality of recesses and protrusions on opposite sides of the distal portion, wherein a cross section thickness at any point along the distal portion is less than a nominal thickness of the hammer; and a plurality of mounting pins to fit in each said mounting aperture to pivotally couple each said hammer to the rotary head.

25. A reducing machine for reducing material, the reducing machine comprising:

a rotary head;

a reducing chamber enclosing the rotary head;

a plurality of hammers, each said hammer including a proximal portion defining a mounting aperture extending through the first major surface to the second major surface;

a distal portion having a leading face to initially impact the material to be reduced, an opposite trailing face, and an outwardly-facing wear edge extending rearwardly from the leading face, the distal portion being stepped with recesses and protrusions on each of opposite sides of the distal portion to define a rippled distal portion; and a plurality of mounting pins to fit in each said mounting aperture to pivotally couple each said hammer to the rotary head.

26. A reducing machine for reducing material, the reducing machine comprising:

a rotary head;

a reducing chamber enclosing the rotary head;

a plurality of hammers, each said hammer including a mounting portion including a first major surface, an opposite second major surface, and a mounting aperture, the mounting portion defining a thickness extending transversely between the first major surface and the second major surface; and a working portion including a first side facing in the same direction as the first major surface of the mounting portion and a second side facing in the same direction as the second major surface, each of the first and second sides including at least one outer surface and at least one recessed surface to define at least one recess on each of the sides, each said outer surface on one side being transversely aligned with one recessed surface on the opposite side, the outer surfaces on the sides defining an overall thickness of the working portion, the overall thickness of the working portion being greater than the first thickness of the mounting portion, and the transverse thickness between any transversely aligned recessed and outer surfaces being the same or less than the thickness of the mounting portion; and a plurality of mounting pins to fit in each said mounting aperture to pivotally couple each said hammer to the rotary head.

* * * * *